US008999137B2

(12) United States Patent
Glass et al.

(10) Patent No.: US 8,999,137 B2
(45) **Date of Patent: *Apr. 7, 2015**

(54) SACRIFICIAL ANODE AND TREATMENT OF CONCRETE

(76) Inventors: Gareth Kevin Glass, Lichfield (GB); Adrian Charles Roberts, Nottingham (GB); Nigel Davison, Swadlincote (GB)

( * ) Notice: Subject to any disclaimer, the term of this patent is extended or adjusted under 35 U.S.C. 154(b) by 316 days.

This patent is subject to a terminal disclaimer.

(21) Appl. No.: 13/537,716

(22) Filed: Jun. 29, 2012

(65) Prior Publication Data

US 2012/0261270 A1 Oct. 18, 2012

Related U.S. Application Data

(63) Continuation-in-part of application No. 12/636,411, filed on Dec. 11, 2009, now Pat. No. 8,211,289, which is a continuation-in-part of application No. 11/908,858, filed as application No.

(Continued)

(30) Foreign Application Priority Data

| | | |
|---|---|---|
| Oct. 20, 2004 | (GB) | 0423251.8 |
| Mar. 16, 2005 | (GB) | 0505353.3 |
| Oct. 4, 2005 | (GB) | 0520112.4 |
| Jan. 13, 2006 | (GB) | 0600661.3 |

(51) Int. Cl.
*C23F 13/00* (2006.01)
*C23F 13/06* (2006.01)

(Continued)

(52) U.S. Cl.
CPC ..... *C23F 13/06* (2013.01); *C23F 13/005* (2013.01); *C23F 13/04* (2013.01); *C23F 13/20* (2013.01); *C23F 2213/20* (2013.01); *C23F 2201/02* (2013.01); *C23F 2213/21* (2013.01)

(58) Field of Classification Search
CPC ..... C23F 13/00; C23F 13/02; C23F 13/08; C23F 13/12; C23F 13/14; C23F 13/16; C23F 13/10; C23F 13/20
USPC ..... 204/196.01, 196.3, 196.36, 196.38, 204/196.1, 196.21, 196.23, 196.25, 196.02, 204/196.04; 205/725, 730, 739, 734, 735
See application file for complete search history.

(56) References Cited

U.S. PATENT DOCUMENTS

| | | | |
|---|---|---|---|
| 4,486,288 | A | 12/1984 | Linder |
| 4,861,449 | A | 8/1989 | St. Onge |

(Continued)

FOREIGN PATENT DOCUMENTS

| | | | |
|---|---|---|---|
| EP | 0186334 | A1 | 7/1986 |
| EP | 0499437 | A1 | 8/1992 |

(Continued)

OTHER PUBLICATIONS

Corrosion 98 Conference, Paper No. 510, Jack Tinnea, John S. Tinnea & Associates, 976—20th Avenue, Seattle, WA 98122-4736, "Field Performance of Sprayed Zinc Anodes in Controlling Corrosion of Steel Reinforced Concrete", Copyright 1998, pp. 8.

(Continued)

*Primary Examiner* — Luan Van
*Assistant Examiner* — Alexander W Keeling
(74) *Attorney, Agent, or Firm* — Davis & Bujold, PLLC; Michael J. Bujold

(57) ABSTRACT

A method of protecting a metal section in concrete. The method comprises the steps of providing a sacrificial anode and embedding the sacrificial anode in a porous matrix in the cavity; providing a source of DC power with positive and negative connections and electrically connecting one of the connections of the source of DC power to the metal section to be protected; electrically connecting the a sacrificial anode in series with the other connection of the source of DC power and spacing the source of DC power from the cavity and the connections to the source of DC power which comprise at least one of wires and cables; and driving an anode current density from the sacrificial anode in excess of 500 mA/m$^2$. An apparatus of protecting a metal section in concrete is also disclosed.

11 Claims, 5 Drawing Sheets

Related U.S. Application Data

PCT/GB2006/050054 on Mar. 14, 2006, now Pat. No. 7,909,982, and a continuation-in-part of application No. 11/577,661, filed as application No. PCT/GB2005/050186 on Oct. 17, 2005, now Pat. No. 7,749,362.

(51) Int. Cl.
*C23F 13/04* (2006.01)
*C23F 13/20* (2006.01)

(56) References Cited

U.S. PATENT DOCUMENTS

| | | | | |
|---|---|---|---|---|
| 4,900,410 | A | 2/1990 | Bennett et al. | |
| 5,139,634 | A | 8/1992 | Carpenter et al. | |
| 5,254,228 | A | 10/1993 | Westhof et al. | |
| 5,292,411 | A | 3/1994 | Bartholomew et al. | |
| 5,366,670 | A * | 11/1994 | Giner et al. | 205/83 |
| 5,421,968 | A | 6/1995 | Bennett et al. | |
| 5,538,619 | A | 7/1996 | Miller | |
| 5,650,060 | A | 7/1997 | Huang et al. | |
| 5,674,561 | A | 10/1997 | Dietz et al. | |
| 5,714,045 | A | 2/1998 | Lasa et al. | |
| 5,968,339 | A | 10/1999 | Clear | |
| 6,022,469 | A | 2/2000 | Page | |
| 6,027,633 | A * | 2/2000 | Whitmore | 205/734 |
| 6,120,675 | A | 9/2000 | Hill et al. | |
| 6,165,346 | A | 12/2000 | Whitmore | |
| 6,193,857 | B1 | 2/2001 | Davison et al. | |
| 6,217,742 | B1 | 4/2001 | Bennett | |
| 6,238,545 | B1 | 5/2001 | Allebach et al. | |
| 6,258,236 | B1 | 7/2001 | Hird | |
| 6,265,105 | B1 | 7/2001 | Tokuda et al. | |
| 6,303,017 | B1 * | 10/2001 | Page et al. | 205/734 |
| 6,322,691 | B1 | 11/2001 | Miller | |
| 6,332,971 | B1 | 12/2001 | Hill | |
| 6,346,188 | B1 | 2/2002 | Shuster et al. | |
| 6,419,816 | B1 | 7/2002 | Lyublinski | |
| 6,540,886 | B1 | 4/2003 | Russell | |
| 6,572,760 | B2 | 6/2003 | Whitmore | |
| 6,793,800 | B2 | 9/2004 | Whitmore | |
| 6,958,116 | B1 | 10/2005 | Bennett | |
| 7,264,708 | B2 * | 9/2007 | Whitmore et al. | 205/734 |
| 7,488,410 | B2 | 2/2009 | Bennett et al. | |
| 7,648,623 | B2 | 1/2010 | Glass | |
| 7,704,372 | B2 | 4/2010 | Glass et al. | |
| 7,749,362 | B2 | 7/2010 | Glass et al. | |
| 7,909,982 | B2 * | 3/2011 | Glass et al. | 205/734 |
| 2004/0011669 | A1 | 1/2004 | Glass et al. | |
| 2004/0186221 | A1 | 9/2004 | Pitchumani et al. | |
| 2004/0238347 | A1 | 12/2004 | Bennett | |
| 2006/0108235 | A1 | 5/2006 | Whitmore et al. | |
| 2007/0194774 | A1 | 8/2007 | Bennett et al. | |
| 2008/0047843 | A1 | 2/2008 | Glass et al. | |
| 2008/0073223 | A1 | 3/2008 | Glass | |
| 2008/0230398 | A1 | 9/2008 | Glass et al. | |
| 2010/0314262 | A1 | 12/2010 | Glass et al. | |
| 2011/0168571 | A1 * | 7/2011 | Glass et al. | 205/734 |
| 2013/0118916 | A1 * | 5/2013 | Glass et al. | 205/734 |

FOREIGN PATENT DOCUMENTS

| | | | |
|---|---|---|---|
| GB | 2194962 | A | 3/1988 |
| GB | 2309978 | A | 8/1997 |
| GB | 2389591 | A | 12/2003 |
| JP | 60029478 | A | 2/1985 |
| JP | 02-200787 | | 8/1990 |
| JP | 4116184 | A | 4/1992 |
| JP | 9031675 | A | 2/1997 |
| WO | 9429496 | A1 | 12/1994 |
| WO | 9816670 | A1 | 4/1998 |
| WO | 0233148 | | 4/2002 |
| WO | 03/010358 | A2 | 2/2003 |
| WO | 2004/057057 | A | 7/2004 |

OTHER PUBLICATIONS

Specification for Sulfate-Resisting Portland Cement, British Standards Institution, BS 4027, 1996.

Cement—Part 1: Compositions, Specifications, and Conformity Criteria for Common Cements, British Standards Institution, BS EN 197 1:2000, Incorporating Amendment No. 1, 2004.

Written Opinion mailed Mar. 29, 2006 in PCT/GB2005/001651.

UK search report mailed Aug. 17, 2005 in GB 0505353.3.

UK combined search and examination report mailed Mar. 10, 2006 in GB 0520112.4.

UK search report mailed May 22, 2006 in GB 0600661.3.

International Search Report mailed Mar. 19, 2007 in PCT/GB2006/050054.

Written Opinion mailed Mar. 19, 2007 in PCT/GB2006/050054.

References entered on Jun. 24, 2009 in U.S. Appl. No. 11/587,647.

Letter dated Aug. 24, 2006 published in the European Patent Office file of EP 01979867.7 which is the equivalent of US 6,419,816, (Lyublinski).

Glass, Developments in Cathodic Protection Applied to Reinforced Concrete, Sep./Oct. 2001, Journal of Materials in Civil Engineering, vol. 13 (No. 5) pp. 396-398.

Glass et al, Cathodic Protection Afforded by an Intermittent Current Applied to Reinforced Concrete, 2001, Corrosion Science, vol. 43, issue 6, pp. 1111-1131.

Glass et al, Criteria for Novel Electrochemical Treatments of Steel in Concrete, Oct. 13-15, 2003, Conference Proceedings, 7th International Conference: Concrete in Hot & Aggressive Environments, Kingdom of Bahrain, pp. 477-491.

Glass et al, Achieving High Chloride Threshold Levels on Steel in Concrete, 2004, Corrosion 2004, Paper No. 04332, pp. 1-17.

Glass et al, Surprisingly Effective Cathodic Protection, 2003, The Journal of Corrosion Science and Engineering, vol. 4, Paper 7, pp. 1-14.

Glass et al, Short Communication: On the Current Density Required to Protect Steel in Atmospherically Exposed Concrete Structures, 2005, Corrosion Science, vol. 37, No. 10, pp. 1643+1646.

British Standards Institution, Cathodic Protection of Steel in Concrete, Mar. 2000, BS EN 12696:2000, pp. 1-40.

European Committee for Standardization, Technical Specification: Electrochemical Realkalization and Chloride Extraction Treatments for Reinforced Concrete, May 2004, prCEN TS 10438-1.

Institute Materials, Electrochemical Rehabilitation Methods for Reinforced Concrete Structures: A State of the Art Report, 1998, European Federation of Corrosion Publications, ed. Mietz, No. 24, pp. 1-3.

http://wvvw.npl.co.uk/ncs/docsfcathodic_protection.pdf, Cathodic Protection, retrieved Dec. 24, 2004, eds. Kean and Davies, sections 5.0, 6.3 and 6.4.

Glass G. K.—"Technical note: The 100mV decay cathodic protection criterion" Corrosion 55(3) (1999) pp. 286-290.

Glass G. K. & Buenfeld N. R—"Theoretical basis for design of reinforced concrete cathodic protection systems" British Corrosion Journal 32(3) (1997) pp. 179-184.

Glass G. K. & Chadwick J. R—"An investigation into the mechanisms of protection afforded by a cathodic protection" Corrosion Science, 36 (12) (1994) pp. 2193-2209.

Glass G. K., Davison N., Roberts A. C. and Taylor J. M., The protective efforts of electrochemical treatment in reinforced concrete, Corrosion 2003, NACE, Paper No. 93291, (San Diego, Mar. 2003).

Glass G. K., Hassanein A. M. & Buenfeld N. R.—"CP Criteria for reinforced concrete in marine exposure zones" Journal of Materials in Civil Engineering vol. 12, No. 2 May 2000, pp. 164-171.

* cited by examiner

SACRIFICIAL ANODE AND TREATMENT OF CONCRETE

CROSS REFERENCES TO RELATED APPLICATIONS

This application is a continuation in part application of application Ser. No. 11/577,661 filed Apr. 20, 2007 which is a national stage completion of PCT/GB2005/50186 filed Oct. 17, 2005 which claims priority from UK patent application number GB 0423251.8 filed Oct. 20, 2004 and is also a continuation in part application of application Ser. No. 12/636,411 filed Dec. 11, 2009 which is a continuation in part of Ser. No. 11/908,858 filed Mar. 14, 2006 which is a national stage completion of PCT/GB2006/050054 filed Mar. 14, 2006 which claims priority from UK patent application numbers GB 0600661.3 filed Jan. 13, 2006, GB 0520112.4 filed Oct. 4, 2005 and GB 0505353.3 filed Mar. 16, 2005.

TECHNICAL FIELD

The present invention relates to sacrificial anode assemblies suitable for use in the protection of steel reinforcements in concrete, to methods of electrochemical protection of steel reinforcement in concrete and to reinforced concrete structures wherein the reinforcement is protected by electrochemical protection.

BACKGROUND OF THE INVENTION

The cathodic protection of metal sections of structures is well known. This technique provides corrosion protection for the metal section by the formation of an electrical circuit that results in the metal section acting as a cathode and, therefore, oxidation of the metal is restricted.

An anode is generally an electrode that supports a substantial net oxidation reaction. A cathode is generally an electrode that supports a substantial net reduction reaction. A metal surface may contain both anodic areas and cathodic areas. A spontaneous corrosion cell occurs on a metal surface that supports both anodic and cathodic reactions (oxidation and reduction reactions respectively). A cell of a battery is typically an isolated chemical reactor that spontaneously generates a potential difference between its positive and negative electrodes (its cathode and anode respectively). Cathodic protection is an electrochemical treatment for steel in concrete.

One known type of system for cathodic protection is an impressed current system, which makes use of an external power supply, either mains or battery, to apply current to the metal section to be protected so as to make it a cathode. These systems generally require complex circuits to apply the current appropriately and control systems to control the application of the current. Furthermore, those that are supplied with mains power clearly can encounter difficulties with power supply problems such as power surges and power cuts, whilst those powered by battery have to overcome the issue of locating the battery at an appropriate position, which both allows the battery to function correctly and supports the weight of the battery.

Such impressed current systems may have a battery secured to the exterior of the structure containing the metal sections to be protected, which clearly adversely affects the appearance of the structure.

Other systems for cathodic protection, which avoid the need for bulky or complex components (e.g., power supplies and electrical wiring) make use of a sacrificial anode coupled to the metal section. The sacrificial anode is a more reactive metal than the metal of the metal section and, therefore, it corrodes in preference to the metal section, and thus the metal section remains intact. This technique is commonly used in the protection of steel reinforcements in concrete, by electrically connecting the steel to a sacrificial anode, with the circuit being completed by electrolyte in the pores of the concrete. This system is termed a sacrificial or galvanic system.

The anodes used in the impressed current system are usually inert anodes comprising carbon or titanium. In these anodes, the anodic reaction substantially comprises the conversion of water into oxygen gas and acid. By contrast, the anodic reaction on sacrificial anodes substantially comprises the dissolution of the sacrificial metal element. The advantage of sacrificial anodes is that they can be used without a power supply, but the disadvantage is that they are eventually consumed. They, therefore, are not generally used in impressed current systems. A well known exception to this occurs with zinc or aluminum alloys that are thermally sprayed as a coating onto the concrete surface and are used with a power supply. While these anodes are eventually consumed during the process of delivering protection, they are readily replaced because they are applied to an exposed concrete surface. However, sacrificial metal dissolution occurs, at the interface between the sacrificial anode and the electrolyte. As a result sacrificial anodes applied directly to the concrete surface often exhibit adhesion problems.

Anodes for sacrificial systems include compact discrete zinc anodes in contact with a purpose designed backfill embedded in cavities within the concrete and thermally applied coatings of zinc and aluminum applied to the concrete surface. Surface applied sacrificial anodes exhibit adhesion problems, while embedded compact discrete anodes lack the power to arrest an aggressive corrosion process because they have to drive more current through a small volume of concrete near the anode. The effective anode circuit resistance of embedded compact discrete anodes is high relative to surface applied sacrificial anodes.

Examples of problems with both impressed current and sacrificial anode systems are provided in a Virginia Transportation Research Council report number VTRC 07-r35 entitled "Survey of Cathodic Protection Systems on Virginia Bridges," dated June 2007, and available from http://www.virginiadot.org/vtrc/main/online_reports/pdf/07435.pdf.

A problem associated with sacrificial cathodic protection arises from the fact that it is the galvanic voltage, between the sacrificial anode and the metal section, that drives current through the electrolyte between these components. This voltage is limited by the natural potential difference that exists between the metal section and the sacrificial anode. Accordingly, the higher the resistance of the electrolyte, the lower the current flow is across the electrolyte between a given metal section and sacrificial anode, and hence the application of sacrificial cathodic protection is restricted.

Protection of the steel reinforcements is, in particular, required when chloride ions are present at significant concentrations in the concrete, and therefore cathodic protection is widely used in relation to concrete structures in locations which are exposed to salt from road de-icing or from marine environments.

There is a need for a sacrificial anode arrangement that can give rise to a voltage between itself and the metal section greater than the natural potential difference that exists between the metal section and the material of the sacrificial anode wherein the anode is strongly attached to the concrete structure.

SUMMARY OF INVENTION

A sacrificial anode assembly, for cathodically protecting and/or passivating a metal section, comprises a cell, which has an anode and a cathode arranged so as to not be in electronic contact with each other but so as to be in ionic contact with each other such that ionic current can flow between the anode and the cathode, wherein the anode of the cell is attached to an electron conducting connector for electrically connecting the anode of the cell to the metal section to be cathodically protected, and the cathode of the cell is electrically connected, in series, with a sacrificial anode with an electron conducting connector. The cell will usually be isolated from the environment such that current can only flow into and out of the cell via the sacrificial anode and the connector connected to the anode of the cell. The cell may be replaced by another source of DC power. The cell or the source of DC power may be located remotely from the sacrificial anode but connected to the source of DC power by an elongated electrical connector. The cell may also be assembled with the sacrificial anode to form a sacrificial anode assembly. The sacrificial anode is preferably buried in a cavity formed in the concrete for the purpose of installing the sacrificial anode. The cavity is preferably a cored or drilled hole or a cut chase or slot in the concrete. The connection to the sacrificial anode is preferably protected from corrosion and may be an elongated electrical connector such as an electrical cable or wire. The connection to the sacrificial anode preferably comprises titanium.

In one best mode a method of cathodically protecting a metal section in concrete includes generating a voltage between two connections of a power supply such that current can flow between a negative connection and a positive connection. In a first protection step, one of the connections of the power supply is electrically connected to the metal section to be cathodically protected and a sacrificial anode is electrically connected in series with the other connection of the power supply such that the voltage generated by the power supply is added to the voltage generated between the sacrificial anode and the metal to produce a voltage greater than the galvanic voltage generated between the sacrificial anode and the metal section alone. It is preferable that DC current can only flow into and out of the power supply via the sacrificial anode and a connector connected to the metal section. The power supply may be a cell. In a second protection step that follows the first protection step, the voltage generated by the power supply is no longer present and a current flows between the sacrificial anode and the metal to continue protecting and/or passivating the metal section, where the current is generated solely by the galvanic voltage between the sacrificial anode and the metal. This may be achieved by connecting the sacrificial anode directly to the metal section.

In another best mode a method of protecting a metal section in concrete comprises providing a sacrificial anode; embedding the sacrificial anode in a porous matrix in the cavity; providing a source of DC power; electrically connecting one of the connections of the source of DC power to the metal section to be protected; and electrically connecting the a sacrificial anode in series with the other connection of the source of DC power; wherein the source of DC power is located away from the cavity and the connections to the source of DC power comprise at least one of: wires, cables; and wherein the current driven of the sacrificial anode exceeds 500 mA/m$^2$. It is preferable that the current driven of the sacrificial anode exceeds 1000 mA/m$^2$. The anode is preferably activated with an activating agent. The cavity in the concrete is preferably at least one of: a cored hole; a drilled hole; a cut chase. The protection of the metal section is using the sacrificial anode and power supply is preferably followed by disconnecting and removing the power supply. After the power supply has been removed, it is preferable to connect the sacrificial anode to the metal section so that a current flows between the sacrificial anode and the metal to continue protecting the metal section, where the current is generated solely by the galvanic voltage between the sacrificial anode and the metal. The metal section may be steel reinforcement in concrete. The power supply may be a potentiostat.

ADVANTAGEOUS EFFECTS

When such an assembly is connected to a metal section to be cathodically protected, for example a steel section in concrete, the potential difference between the metal section and the sacrificial anode is greater than the natural potential difference between the metal section and the sacrificial anode, and therefore a useful level of current flow can be achieved even in circuits with high resistance. Accordingly, the sacrificial anode assembly can be used to provide sacrificial cathodic protection of a metal section in locations whereby sacrificial cathodic protection was not previously able to be applied at a useful level due to the circuit between the metal section and the sacrificial anode being completed by a material, such as an electrolyte, of high resistance. A useful level of protection may also be achieved with compact discrete sacrificial anodes embedded within the concrete wherein the resistance is high because the area and volume of electrolyte contacting the surface of the sacrificial anode is small. Embedding the anode in a cavity ensures that it is strongly attached to the concrete.

Further, as the potential difference between the metal section and the sacrificial anode is greater than the natural potential difference between the metal section and the sacrificial anode, it is possible to have increased spacing between anodes where a multiplicity of sacrificial anode assemblies are deployed in a structure. This may reduce the total number of assemblies required in a given structure.

In addition, the assembly of the present invention produces a high initial current. This is in particular useful as it allows the assembly to be used to passivate metals, such as steel, which metals may be in an active corrosion state or may be in new concrete. Furthermore, the assembled anode assembly of the present invention may suitably be located in a concrete or other structure that includes a metal section requiring cathodic protection, or may be encased in a material identical or similar to that of the structure and this encased assembly may then be secured to the exterior of the structure. The look of the structure can therefore be maintained, as no components dissimilar in appearance to the structure itself are present on the exterior of the structure.

DETAILED DESCRIPTION

The invention will now be further described in the following examples, with reference to the drawings in which:

FIG. 1*a* shows a cross section through a sacrificial anode assembly in accordance with the invention;

FIG. 1*b* shows a section through the sacrificial anode assembly as shown in FIG. 1*a* along section line 1*b*-1*b;*

DETAIL DESCRIPTION OF THE INVENTION

EXAMPLE 1

Figure 1A:
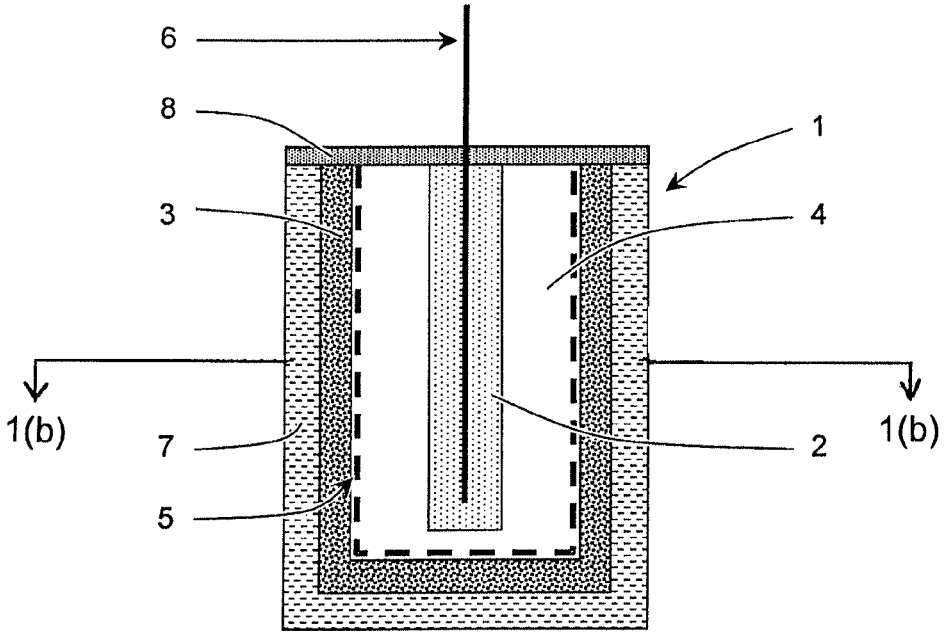

In one example a sacrificial anode and the cell may be connected together so as to form a single unit; in particular the sacrificial anode assembly may be a single assembled unit. This is, advantageous in that it reduces the complexity of the product and makes it easier to embed the assembly in the structure that includes the metal section to be protected or in a material identical or similar to that of the structure.

In particular, the sacrificial anode may be located in the assembly such that it is adjacent to the cell. The sacrificial anode may be of a shape and size corresponding with the shape of at least part of the cell, such that it fits alongside at least part of the cell. In a preferred embodiment the sacrificial anode forms a container within which the cell is located.

The sacrificial anode may be directly connected to the cathode of the cell, being in direct contact with the cathode of the cell, or may be indirectly connected to the cathode of the cell. In one embodiment, the sacrificial anode is indirectly connected to the cathode of the cell via an electronically conductive separator. This is advantageous because it assists in preventing the direct corrosion of the sacrificial anode at its contact with the cathode of the cell. For example, a layer of a metal, such as a layer of plated copper or nickel, may be located between the sacrificial anode and the cathode of the cell so as to allow electronic conduction between these components but to prevent direct contact between these components.

The sacrificial anode must clearly have a more negative standard electrode potential than the metal to be cathodically protected by the sacrificial anode assembly. Accordingly, when the sacrificial anode assembly is for use in reinforced concrete, the sacrificial anode must have a more negative standard electrode potential than steel. Examples of suitable metals are zinc, aluminum, cadmium and magnesium and examples of suitable alloys are zinc alloys, aluminum alloys, cadmium alloys and magnesium alloys. The sacrificial anode may suitably be provided in the form of cast metal/alloy, compressed powder, fibers or foil.

The electrochemical sign convention (more positive or more negative) used in this document places gold as a positive or a noble metal and zinc as a negative or a base metal. A sacrificial anode for steel in concrete is less noble than steel and its anodic reaction substantially comprises the dissolution of the sacrificial metal element. The "less noble" concept is equivalent to the "more negative" concept.

The connector for electrically connecting the anode of the cell to the metal section to be cathodically protected may be any suitable electrical connector, such as a connector known in the art for use with sacrificial anodes. In particular the connector may be steel, galvanized steel or brass, and the connector may suitably be in the form of a wire; preferably the connector is a steel wire.

The cell may be any conventional electrochemical cell. In particular, the cell may comprise an anode which is any suitable material and a cathode which is any suitable material, provided of course that the anode has a more negative standard electrode potential than the cathode. Suitable materials for the anode of the cell include metals such as zinc, aluminum, cadmium, lithium and magnesium and alloys such as zinc alloys, aluminum alloys, cadmium alloys and magnesium alloys. Suitable materials for the cathode include metal oxides such as oxides of manganese, iron, copper, silver and lead, and mixtures of metal oxides with carbon, for example mixtures of manganese dioxide and carbon. The anode and the cathode may each be provided in any suitable form, and may be provided in the same form or in different forms, for example they may each be provided as a solid element, such as in the form of a cast metal/alloy, compressed powder, fibers or foil, or may be provided in loose powdered form.

It is preferred that, as in conventional cells, the anode of the cell is in contact with an electrolyte. When the anode is in loose powdered form, this powder may be suspended in the electrolyte. The electrolyte may be any known electrolyte, such as potassium hydroxide, lithium hydroxide or ammonium chloride. The electrolyte may contain additional agents, in particular it may contain compounds to inhibit hydrogen discharge from the anode, for example when the anode is zinc the electrolyte may contain zinc oxide.

The anode and the cathode of the cell are arranged so as to not be in electronic contact with each other but to be in ionic contact with each other such that ionic current can flow from the anode to the cathode. In this respect, it is preferred that, as in conventional cells, the anode and the cathode are connected via an electrolyte. Suitably, therefore, an electrolyte is provided between the anode and the cathode to allow ionic current to flow between the anode and the cathode.

Ionic current is the transfer of electrical charge via the movement of ions that typically occurs in an electrolyte. Electronic current is the transfer of electrical charge via the movement of electrons that typically occurs in a metal or in carbon.

The cell may be provided with a porous separator located between the cathode and the anode, which consequently prevents electronic contact between the anode and the cathode. This is in particular useful in assemblies of the present invention whereby the anode is provided in loose powdered form, and more particularly when this powder is suspended in the electrolyte. The cell in the assembly may be isolated from the environment, other than to the extent that attachment to the connector and the sacrificial anode makes necessary; this may be achieved by the use of any suitable isolating means around the cell. This isolation is, in particular, beneficial as it ensures that electrolyte in the environment does not come into contact with the cell. The cell may be isolated in this way by one isolating means or more than one isolating means which together achieve the necessary isolation. The isolating means clearly must be electrically insulating material so that current will not flow through it, such as silicone-based material.

In cases where the cell in the assembly is not isolated from the environment and the electrolyte in the cell makes contact with the electrolyte in the environment, the electrolyte in the cell must be compatible with the electrolyte in the environment.

As one of the permitted electrical connections of the cell is an electrical connection to the sacrificial anode, the amount of isolating means required can be reduced by increasing the area of the exterior of the cell located adjacent to the sacrificial anode. Accordingly, in a preferred embodiment the sacrificial anode is in the shape of a container and the cell is located in the container, for example the sacrificial anode may be in the shape of a cylindrical can, i.e., having a circular base and a wall extending upwards from the circumference of the base so as to define a cavity, and the cell is located in this can. The remaining areas of the cell, that are not covered by the sacrificial anode and that are not covered by their contact with the connector, may be isolated from the environment by isolating means.

It is preferred that the quantities of the anode and cathode materials utilized in an assembled cell and sacrificial anode unit are such that they will each deliver the same quantity of charge during the life of the assembly, as this clearly maximizes the efficiency of this system. Stated differently, in this example the anode material in the sacrificial anode holds the same charge as the cathode material in the cell and the same charge as the anode material in the cell. This minimizes the unusable charge left in the assembled unit after the charge is depleted in any one of these elements.

The anode assembly may be surrounded by an encapsulating material, such as a porous matrix. In particular, the assembly may have a suitable encapsulating material pre-cast around it before use. Alternatively, the encapsulating material may be provided after the assembly is located at its intended position, for example after the assembly has been located in a cavity in a concrete structure; in this case a suitable encapsulating material may be deployed to embed the assembly.

The encapsulating material may suitably be such that it can maintain the activity of the sacrificial anode casing, absorb any expansive forces generated by expansive corrosion products, and/or minimize the risk of direct contact between the conductor or protected metal section and the sacrificial anode, which would discharge the internal cell in the anode assembly. The encapsulating material may, for example, be a mortar, such as a cementitious mortar.

Preferably the anode assembly is surrounded by an encapsulating material containing activators to ensure continued corrosion of the sacrificial anode, for example an electrolyte that in solution has a pH sufficiently high for corrosion of the sacrificial anode to occur and for passive film formation on the sacrificial anode to be avoided, when the anode assembly is cathodically connected to the material to be cathodically protected by the anode assembly. In particular, the encapsulating material may comprise a reservoir of alkali such as lithium hydroxide or potassium hydroxide, or other suitable activators known in the art, such as humectants. The encapsulating material is preferably a highly alkaline mortar, such as those known in the art as being of use for surrounding sacrificial zinc. For example, a mortar comprising lithium hydroxide or potassium hydroxide and having a pH of from 12 to 14.

The mortar may suitably be rapid hardening cement; this is particularly of use in embodiments whereby the encapsulating material is to be pre-cast. For example, the mortar may be a calcium sulphoaluminate. The mortar may alternatively be a Portland cement mortar with a water/cement ratio of 0.6 or greater containing additional lithium hydroxide or potassium hydroxide, such as those mortars discussed in U.S. Pat. No. 6,022,469.

EXAMPLE 2

In another example, the present invention provides a method of cathodically protecting metal in which the sacrificial anode assembly in Example 1 above is cathodically attached to the metal via the connector of the assembly. In particular, a method of cathodically protecting steel reinforcement in concrete is provided, in which a sacrificial anode assembly, in accordance with the first aspect of the present invention, is cathodically attached to the steel.

EXAMPLE 3

In another example, the present invention provides a reinforced concrete structure wherein some or all of the reinforcement is cathodically protected by the method described in Example 2.

EXAMPLE 4

Figure 1B:
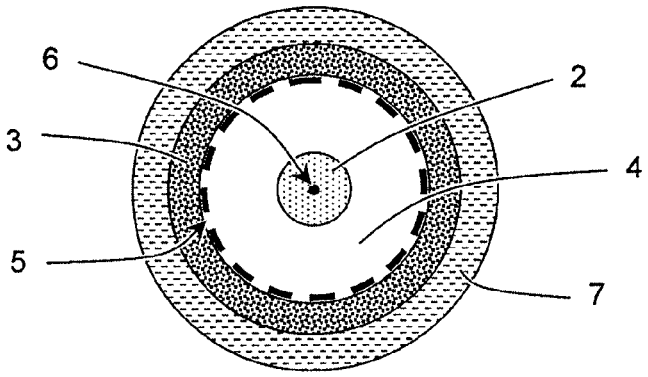

FIG. 1 shows a sacrificial anode assembly 1 for cathodically protecting a metal section. The assembly comprises a cell, which has an anode 2 and a cathode 3. The cathode 3 is a manganese dioxide/carbon mixture and is in the shape of a cylindrical can, having a circular base and a wall extending upwards from the circumference of the base, so as to define a cavity. The anode 2 is a zinc anode of cylindrical shape, with the zinc being cast metal, compressed powder, fibers or foil. The anode 2 is located centrally within the cavity defined by the can shaped cathode 3 and is in contact with electrolyte 4 present in the cavity defined by the can shaped cathode 3, which maintains the activity of the anode of the cell. The electrolyte 4 is suitably potassium hydroxide, and may contain other agents such as zinc oxide to inhibit hydrogen discharge from the zinc. A porous separator 5, which is also generally has a cylindrical can shape, is located inside the cavity defined by the cathode 3, adjacent to the cathode 3. Accordingly, the anode 2 and the cathode 3 are not in electronic contact with each other, but are ionically connected via the electrolyte 4 and the porous separator 5 such that current can flow between the anode 2 and the cathode 3.

The anode 2 is attached to a connector 6 for electrically connecting the anode 2 to the metal section to be cathodically protected. The connector 6 is suitably steel. The cathode 3 of the cell is electrically connected, in series, with a sacrificial anode 7. The sacrificial anode 7 is zinc and is also generally cylindrically can shaped, with the zinc being cast metal, compressed powder, fibers or foil. The cell is located inside the cavity defined by the can shaped sacrificial anode 7. A layer of electrically insulating material 8 is located across the top of the assembly to isolate the cell from the external environment and, accordingly, current can only flow into and out of the cell via the sacrificial anode 7 and the connector 6.

The sacrificial anode assembly 1 may subsequently be surrounded by a porous matrix; in particular a cementitious mortar such as a calcium sulphoaluminate may be pre-cast around the assembly 1 before use. The matrix may also suitably comprise a reservoir of alkali such as lithium hydroxide.

The sacrificial anode assembly 1 may be utilized by being located in a concrete environment and connecting the conductor 6 to a steel bar also located in the concrete. Current is accordingly driven through the circuit comprising the anode assembly 1, the steel and the electrolyte in the concrete, by the voltage across the cell and the voltage between the sacrificial anode 7 and the steel, which two voltages combine additatively. The reactions that occur at the metal/electrolyte interfaces result in the corrosion of the zinc sacrificial anode 7 and the protection of the steel.

EXAMPLE 5

Figure 2:
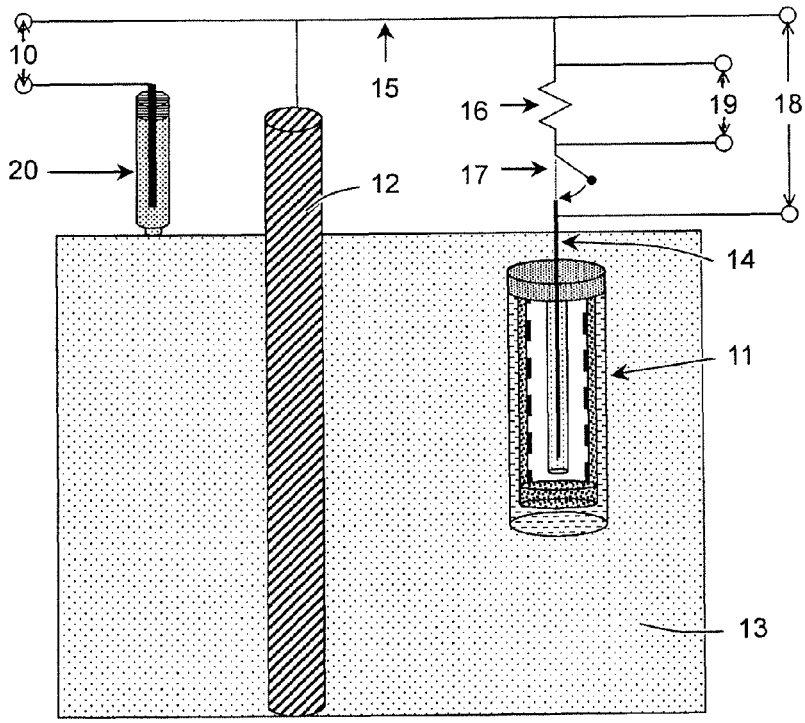
FIG. 2 shows a sacrificial anode assembly of the present invention connected to steel in a test arrangement.

FIG. 2 shows a sacrificial anode assembly 11 connected to a 20 mm diameter mild steel bar 12 in a 100 mm concrete cube 13 consisting of 350 kg/m$^3$ ordinary Portland cement concrete contaminated with 3% chloride ion by weight of cement.

The sacrificial anode assembly 11 comprises a cell, which is an AA size Duracell battery, and a sacrificial anode, which is a sheet of pure zinc folded to produce a generally cylindrically shaped zinc can around the cell. This zinc is folded so as to contact the positive terminal of the cell, and a conductor 14 is soldered to the negative terminal of the cell. A silicone-based sealant is located over the negative and positive cell terminals so as to insulate them from the environment.

Prior to placing the sacrificial anode assembly 11 in the concrete cube, potentials were measured using a digital multimeter with an input impedance of 10 Mohm, which showed that the potential between the external zinc casing and a steel bar, in moist chloride contaminated sand, was 520 mV and the potential between the conductor and the steel was 2110 mV. This suggests that the sacrificial anode assembly 11 would have 1590 mV of additional driving voltage over that of a conventional sacrificial anode to drive current through the electrolyte between the anode and the protected steel.

As shown in FIG. 2, the circuit from the sacrificial anode assembly 11 through the electrolyte in the concrete cube 13 to the steel bar 12 was completed by copper core electric cables 15, with a 10 kOhm resistor 16 and a circuit breaker 17 also being included in the circuit. The drive voltage between the anode and the steel was monitored across monitoring points 18 while the current flowing was determined by measuring the voltage across the 10 kOhm resistor at monitoring points 19. A saturated calomel reference electrode (SCE) 20 was installed to facilitate the independent determination of the steel potential across monitoring points 10.

Figure 3:
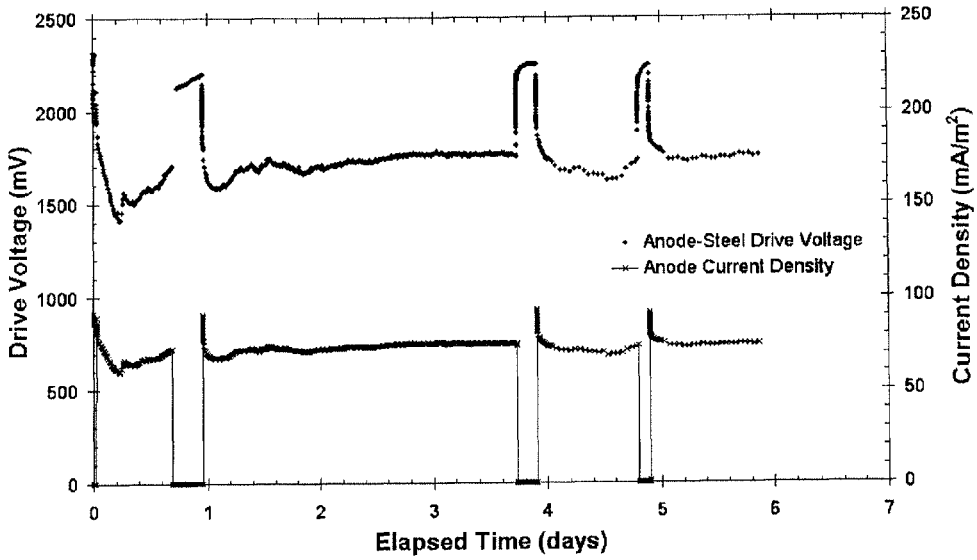
FIG. 3 is a graph showing the drive voltage and current density of the sacrificial anode assembly as shown in FIG. 3.
Figure 4:
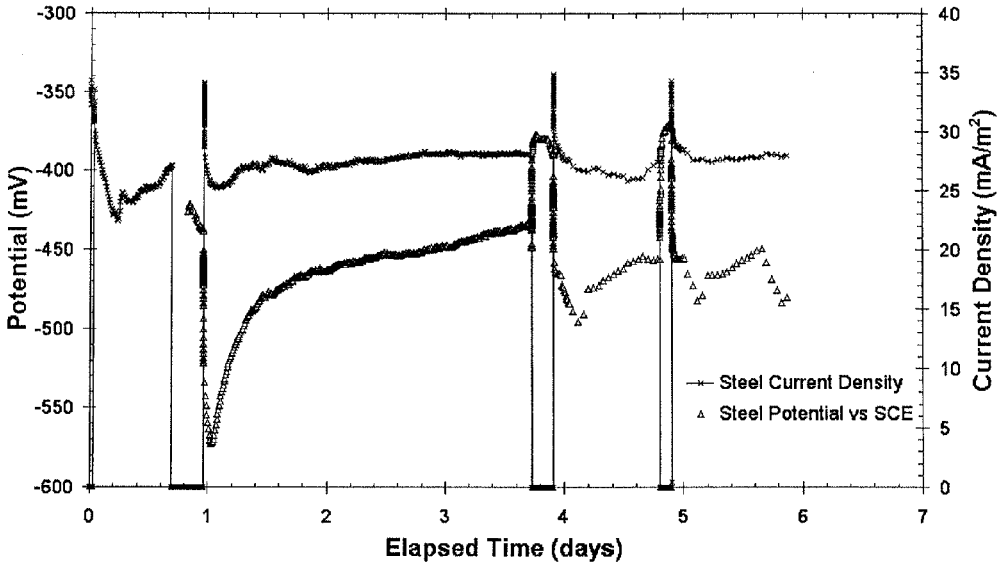
FIG. 4 shows the potential and current density for the protected steel as connected to the sacrificial anode assembly in FIG. 3.

The drive voltage, sacrificial cathodic current and steel potential were logged at regular intervals. The drive voltage and sacrificial cathodic current expressed relative to the anode surface area are shown in FIG. 3. The anode-steel drive voltage was approximately 2.2 to 2.4 volts in the open circuit condition (circuit breaker open) and fell to 1.5 to 1.8 volts when current was been drawn. The steel potential and sacrificial cathodic current expressed relative to the steel surface area are shown in FIG. 4. The initial steel potential varied between −410 and −440 mV on the SCE scale. This varied with the moisture content of the concrete at the point of contact between the SCE and the concrete. This negative potential reflects the aggressive nature of the chloride contaminated concrete towards the steel. The steel current density varied between 25 and 30 mA/m$^2$.

The steel potential decay following the interruption of the current (circuit breaker open) was approximately 100 mV, indicating that steel protection is being achieved. This also means that, of the 1.5 to 1.8 volts anode-steel drive voltage, more than 1.4 volts would be available to overcome the circuit resistance to current flow. This is significantly more voltage than could be provided by a sacrificial anode as currently available to overcome circuit resistance to current flow.

It is therefore clear that in high resistivity environments, i.e., where the circuit resistance to current flow presented by the conditions or arrangement is high, this sacrificial anode assembly has a significant advantage over the more traditional sacrificial anodes currently available.

EXAMPLE 6

When the cell in the above Examples ultimately becomes depleted, any residual sacrificial anode may still remain active and thus may be used to provide cathodic protection to steel in concrete. To enable this, the sacrificial anode needs to have more initial charge than the initial charge in the cell and it needs to be connected to the steel as opposed to being connected through the cell to the steel as a cell or any electrode within the cell that is depleted of charge will inhibit the flow of protection current to the steel. It is preferable that, if residual charge remains within the cell, the sacrificial anode is disconnected from the cathode of the cell before it is connected to the steel to avoid shorting the cathode of the cell to the anode of the cell.

Figure 5:
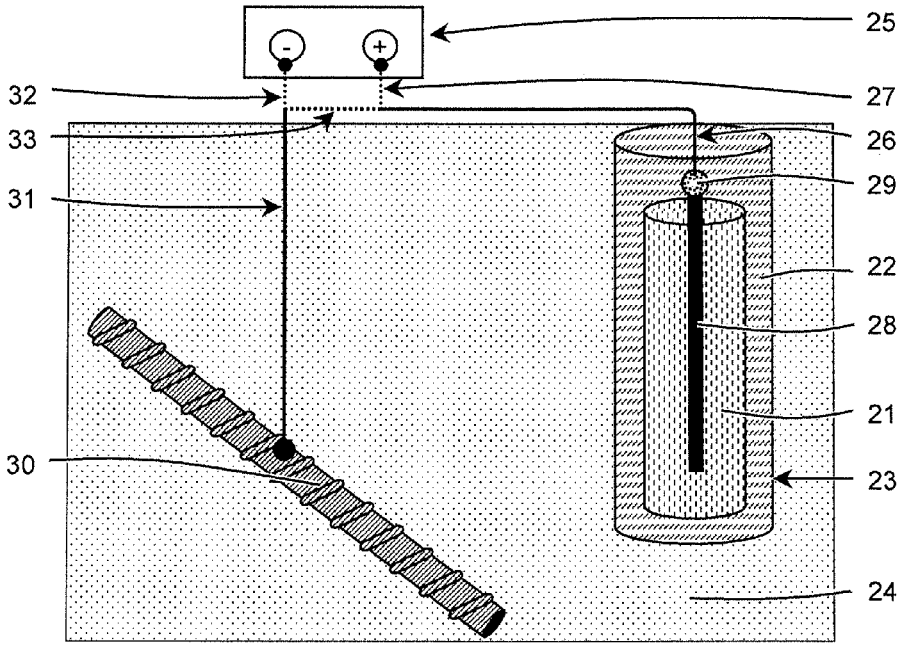
FIG. 5 shows a schematic diagram of the use of a sacrificial anode in a combination of an impressed current and a sacrificial electrochemical treatment using a source of DC power.

One example of such a combination electrochemical treatment is illustrated in FIG. 5. A compact discrete sacrificial anode 21 is preferably embedded in a porous material 22 containing an electrolyte in a cavity 23 formed in concrete 24. The sacrificial anode is connected to the positive terminal of a source of DC power 25 using a permanent electrical conductor 26 and temporary electrical connection 27. An impressed current anode connection is preferably used to connect the sacrificial anode 21 to the electrical conductor 26. This may involve forming the sacrificial metal element around a portion of a conductor 28 that remains passive during the impressed current treatment. The conductor 28 provides a convenient connection point 29, away from the embedded sacrificial anode, to facilitate a connection to another electrical conductor. The negative terminal of the power source 25 is connected to the steel 30 using a permanent electrical conductor 31 and a temporary connection 32. While the power supply is connected to the sacrificial anode and the steel, a by-pass electrical connection 33 is not made.

Initially, an impressed current is driven from the sacrificial anode 21 to the steel 30 using the source of DC power 25. After a period of impressed current treatment, the power supply may be disconnected by disconnecting temporary electrical connections 27 and 32 and the sacrificial anode may be connected to the steel through the by-pass electrical connection 33. This connection preferably has a low resistance such that typically less than 100 mV and more preferably less than 10 mV of the drive voltage between the sacrificial anode and the steel will fall across this connection. The compact discrete sacrificial anode then continues to provide sacrificial cathodic protection also known as galvanic protection. The power supply may then be removed which minimizes the bulky or complex components (e.g., power supplies and electrical wiring) that are left on a structure. The impressed current treatment is preferably a high current treatment relative to the subsequent sacrificial cathodic protection to passivate the steel.

The connections 27, 29, 32, 33 and conductors 26, 28, 31 are all electron conducting connections or conductors in that they provide a path for electrons to move. They may be referred to as electronic connections or electronic conductors. The conductors would typically be wires or electrical cables.

The sources of DC power 25, for the impressed current treatment, include a main powered DC power supply or a battery or a cell. It is an advantage if the connection between the sacrificial anode and the positive terminal of the power supply is kept as short as possible to minimize the corrosion risk to this electrical connection. Steel and galvanized steel connections commonly found on sacrificial anode assemblies are at risk of becoming part of the anode system, and therefore at risk of corrosion if they are connected to the positive terminal of a DC power supply.

An impressed current connection overcomes the risk of induced connection corrosion when a conductor making the connection to an anode is connected to the positive terminal of a power supply and the connection makes contact with the electrolyte that in turn makes electrolytic contact with the protected metal section connected to the negative terminal of a power supply. A titanium connection is preferred. Titanium is a substantially inert metal. Coatings may also be used to protect connections. Impressed current connections are commonly found on impressed current anodes.

The Example in FIG. 5 shows a sacrificial metal element 21 that is formed around a portion of a conductor 28 with a second portion extending beyond the sacrificial metal providing a connection point 29.

In this Example, the preferred anode assembly comprises a compact discrete sacrificial metal element with an impressed current anode connection. Compact discrete anodes may be embedded in cavities formed in reinforced concrete. This improves the bond between the anode and the concrete structure. The cavity is an empty space in hardened concrete in which to install the sacrificial anode. It is preferably formed for the purpose of installing the sacrificial anode. Examples include cored or drilled holes and cut chases. Preferred holes are up to 50 mm in diameter and 200 mm in length and may be formed by coring or drilling. Preferred chases are up to 30 mm in width and 50 mm in depth that may be cut into the concrete surface by cutting two parallel slots and chiseling out the concrete between the slots. A number of sacrificial anodes will typically be distributed in cavities over the concrete structure so as to protect the embedded steel.

Sacrificial anodes have previously been placed on concrete surfaces where they are accessible and easily replaced. However loss of adhesion to the concrete substrate and rapid drying of the concrete surface in the absence of moisture limits the performance off anodes on the surface. These problems may be overcome by embedding the sacrificial metal anodes in a porous material in cavities in concrete. The porous material holds the anode in place while its porosity also holds the electrolyte and provides space for the products of anode dissolution. The porous material preferably a filler material that hardens with time.

EXAMPLE 7

A sacrificial anode assembly consisting of a base metal, electron conductor and gypsum containing free sulphate ions was produced and tested. The base metal consisted of a block of aluminum alloy measuring 29.7 mm by 11.9 mm by 8.6 mm. The alloy was US Navy specification MIL-A-24779 (SH). An electron conductor consisting of a 1.0 $mm^2$ sheathed copper cable was connected to the aluminum alloy. This connection was made by drilling a 4 mm diameter hole to a depth of 8 mm into the 11.9 by 8.6 mm face of the block, stripping away 8 mm of sheath off the end of the copper core cable alloy, inserting the exposed copper core into the drilled hole and securing it with a 3.5 mm diameter aluminum pop rivet in the drilled hole. The connection was insulated with a fast curing silicone sealant obtained from a builder's merchant. Once the sealant had cured, the aluminum block was suspended centrally in a cylindrical plastic mold made from a 50 mm length of 50 mm diameter plastic pipe with a wall thickness of 1.5 mm. The bottom end was sealed to a non-absorbent plastic base with tape. The mold was filled with a fluid homogeneous mixture of domestic multipurpose finishing plaster, potassium sulphate and tap water in the proportions of 19:1:15 by weight respectively. The aluminum anode assembly was demolded after 24 hours at 20° C. and measured 47 mm in diameter and 48 mm long with a length of sheathed copper cable electrically connected to the aluminum protruding from one of the faces.

Figure 6:
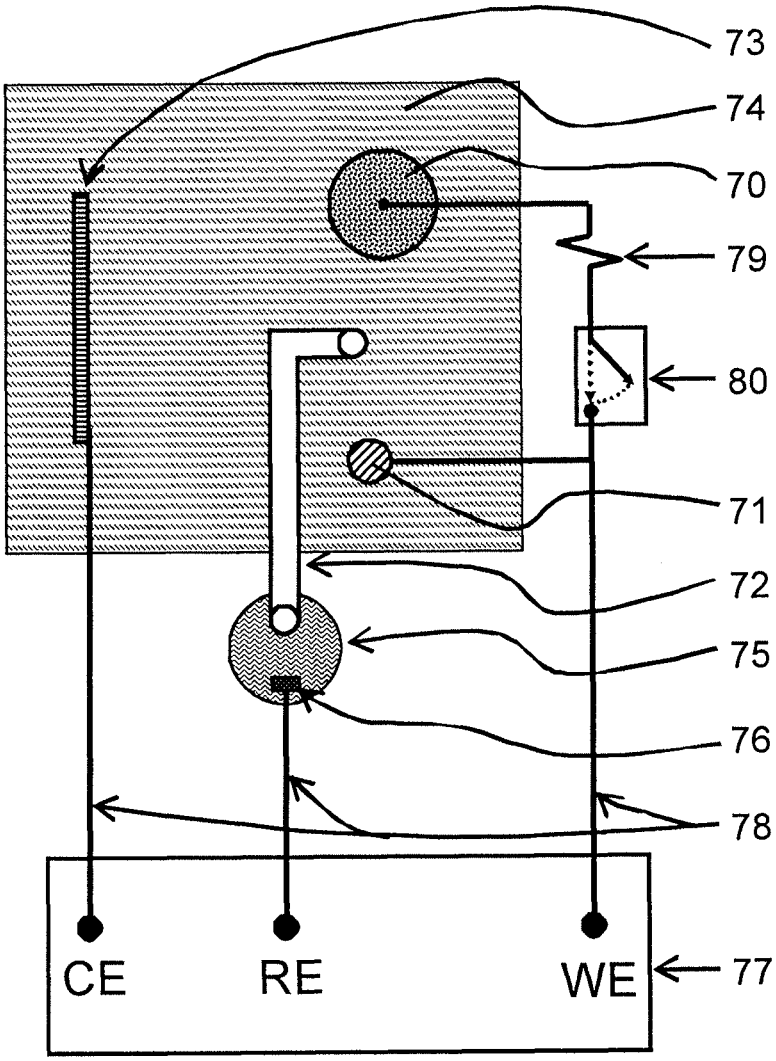
FIG. 6 shows the experimental arrangement used to test an aluminum anode assembly.

The experimental arrangement used to test the aluminum anode assembly is shown in FIG. 6. The aluminum anode assembly 70 a steel bar 71, a Luggin capillary 72 and a counter electrode 73 were cast into a concrete block 74 measuring 110 mm long, 100 mm wide and 100 mm deep using a wooden mold with these internal dimensions. The concrete mix used 20 mm all-in aggregate (0 to 20 mm), ordinary Portland cement and tap water in the proportions of 4:1:0.48 by weight respectively. The steel bar 71, had a diameter of 10 mm and length of 130 mm. It extended 35 mm above the concrete surface. A 1.0 mm2 sheathed copper core cable was connected to the exposed end of the steel bar in a 4 mm diameter hole drilled into the end using a 3.5 mm pop rivet as described above for the cable-aluminum connection. The steel bar 71 was positioned 20 mm from the external surface of the aluminum anode assembly 70. The Luggin capillary 72 consisted of 6 mm flexible plastic pipe with an internal diameter of 2 mm. One end of the Luggin capillary was positioned between the sacrificial anode assembly and the steel in the concrete such that it was 5 to 10 mm from the surface of the sacrificial anode assembly. A counter electrode 73 was made from a length of mixed metal oxide coated titanium ribbon measuring 0.6 mm by 12.6 mm by 45 mm. A copper core cable was connected to the counter electrode and the connection was insulated using a silicone sealant before it was embedded in the concrete.

After one day the concrete was removed from the mold and immersed in water to a depth of 95 mm. The Luggin capillary 72 was filled with conductive gel. This gel was made by heating whilst stirring a mixture of agar powder, potassium chloride and tap water in the proportions of 2:2:100 by weight respectively. The Luggin capillary extended from the concrete to a small container 75 containing a saturated copper sulphate solution. A piece of bright, abraded, copper 76 was placed into the saturated copper sulphate solution to create a saturated copper/copper sulphate reference electrode. A copper core cable was connected to the copper of the reference electrode with the connection being isolated from the copper sulphate solution.

The steel bar, saturated copper/copper sulphate reference electrode and titanium counter electrode were connected to the working electrode (WE), reference electrode (RE) and counter electrode (CE) terminals respectively of a potentiostat 77. The potentiostat 77 is a laboratory power supply that is used to control the potential difference between the working and reference electrode terminals at a preset value by passing a current from the counter electrode to the working electrode. Three 1 $mm^2$ sheathed copper core cables 78 were used for all of the connections. A 1 Ohm resistor 79 and a relay switch 80 were connected between the aluminum anode assembly and the steel. The current flow from the aluminum anode assembly was determined by measuring the voltage drop across the 1 Ohm resistor. The testing took place in laboratory conditions at 15 to 20° C.

Four days after casting the specimen, the potentiostat 77 was set to control the potential of the steel bar at −350 mV relative to the saturated copper/copper sulphate reference electrode. The measurements included the current from the aluminum anode assembly, the current-on potential relative to the reference electrode measured while the current was flowing from the aluminum anode assembly and the instant-off potential of the aluminum anode assembly relative to the reference electrode measured between 0.02 and 0.07 seconds after momentarily interrupting the current from the anode assembly for a period of no more that 0.15 seconds using the relay switch. These measurements were recorded using a high impedance data logger which also controlled the relay switch 80.

After recording the current, current-on potential and instant-off potential for three days the aluminum anode assembly was put through a polarization test. A function generator was connected to the potentiostat 77 to change the controlled potential at a rate of 0.33 mV/s and to cycle this change up and down. The data logger recorded the current output of the anode assembly and the instant-off potential while the potential was changed. The steel bar was disconnected in this test to avoid causing corrosion to the steel bar. In this test current was driven (or impressed) from the anode assembly on to the counter electrode.

Figure 7:
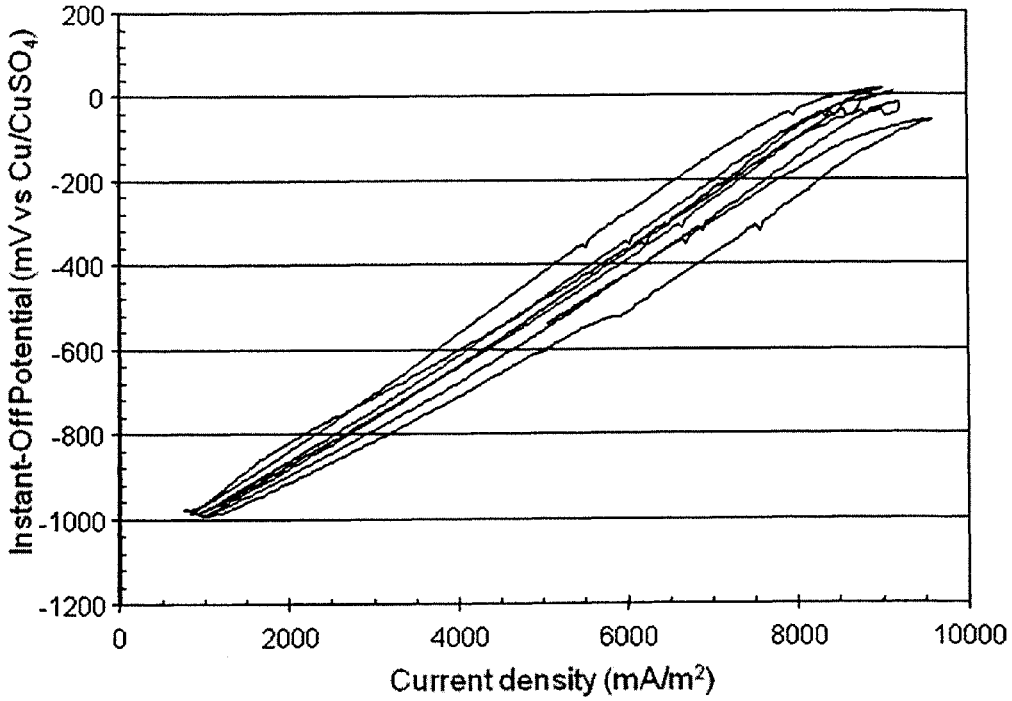
FIG. 7 shows the polarization behavior determined on the aluminum anode assembly over four successive potential cycles.

FIG. 7 shows the polarization behavior determined on the aluminum anode assembly over 4 successive potential cycles. As the instant-off potential of the anode increased from −1000 mV to 0 mV, the current density off the aluminum increased from under 1000 mA/m$^2$ to 9000 mA/m$^2$.

Other Examples

From the above description of the invention, those skilled in the art will perceive improvements, changes and modifications. Such improvements, changes and modifications within the skill of the art are intended to be covered by the appended claims.

The invention claimed is:

1. A method of protecting a metal section in concrete, the method comprising the steps of:

forming a cavity in concrete;

providing a sacrificial anode;

embedding the sacrificial anode in a porous matrix in the cavity:

providing a source of DC power with positive and negative connections;

electrically connecting one of the positive and the negative connections of the source of DC power to the metal section to be protected; and electrically connecting the sacrificial anode in series with the other of the positive and the negative connection of the source of DC power;

spacing the source of DC power from the cavity and the connections to the source of DC power which comprise at least one of wires and cables; and driving an anode current density from the sacrificial anode in excess of 500 mA/m$^2$.

2. The method as claimed in claim 1, further comprising a step of driving the anode current density from the sacrificial anode assembly in excess of 1000 mA/m$^2$.

3. The method as claimed in claim 1, further comprising a step of activating the anode with an activating agent.

4. The method as claimed in claim 1, further comprising a step of forming the cavity in the concrete as at least one of:

a cored hole;

a drilled hole; and a cut chase.

5. The method as claimed in claim 1, further comprising a subsequent step of disconnecting and removing the source of DC power from a structure containing the protected metal section and the concrete.

6. The method as claimed in claim 5 wherein, following removal of the power supply, the method further comprising the steps of connecting the sacrificial anode to the metal section so that a current flows between the sacrificial anode and the metal to continue protecting the metal section, and generating the current solely by the galvanic voltage between the sacrificial anode and the metal.

7. The method as claimed in claim 1, further comprising a step of using steel reinforcement in concrete as the metal section.

8. The method as claimed in claim 1, further comprising a step of using a potentiostat as the source of DC power.

9. The method as claimed in claim 2, further comprising a step of using a potentiostat as the source of DC power.

10. The method as claimed in claim 6, further comprising a step of using a potentiostat as the source of DC power.

11. The method as claimed in claim 1, further comprising a step of forming the cavity to be one of a cored or a drilled hole up to 50 mm in diameter and 200 mm in depth, or a cut chase up to 30 mm in width and 50 mm in depth.

* * * * *